US005267576A

United States Patent [19]

Heitmann

[11] Patent Number: 5,267,576

[45] Date of Patent: Dec. 7, 1993

[54] METHOD OF AND APPARATUS FOR SEPARATING FOREIGN OBJECTS FROM MOVING TOBACCO PARTICLES IN A ROD MAKING MACHINE

[75] Inventor: Uwe Heitmann, Hamburg, Fed. Rep. of Germany

[73] Assignee: Körber AG, Hamburg, Fed. Rep. of Germany

[21] Appl. No.: 845,729

[22] Filed: Mar. 4, 1992

[30] Foreign Application Priority Data

Mar. 6, 1991 [DE] Fed. Rep. of Germany ..... 4107113

[51] Int. Cl.[5] ..... A24C 5/00; A24C 5/18; A24C 5/14

[52] U.S. Cl. ..... 131/84.1; 131/109.2; 131/110

[58] Field of Search ..... 131/280, 84.1, 84.3, 131/84.4, 110, 109.2, 311, 312, 322

[56] References Cited

U.S. PATENT DOCUMENTS

| | | | |
|---|---|---|---|
| 4,185,644 | 1/1980 | Heitmann | 131/109.2 |
| 4,538,626 | 9/1985 | Hinzmann | 131/84.4 |
| 4,607,645 | 8/1986 | Okumoto et al. | 131/109.2 X |
| 4,889,138 | 12/1989 | Heitmann | 131/84.1 |
| 4,893,640 | 1/1990 | Heitmann | 131/84.4 |
| 4,924,885 | 5/1990 | Heitmann | 131/84.4 |
| 4,998,540 | 3/1991 | Brand | 131/110 |
| 5,072,742 | 12/1991 | Heitmann | 131/84.4 |
| 5,148,816 | 9/1992 | Heitmann | 131/84.1 |
| 5,154,190 | 10/1992 | Heitmann | 131/84.1 |

FOREIGN PATENT DOCUMENTS 2729730 11/1986 Fed. Rep. of Germany .

*Primary Examiner*—V. Millin
*Assistant Examiner*—J. Doyle
*Attorney, Agent, or Firm*—Peter K. Kontler

[57] ABSTRACT

A cigarette rod making machine wherein the flow of loosely intermingled tobacco shreds, tobacco ribs and foreign objects (such as nuts, bolts, pieces of wire and-/or particles of plastic material) is classified to segregate the ribs and foreign objects from the shreds. The ribs are thereupon separated from foreign objects in a sifter and are comminuted in a rotary cutter prior to being readmitted into the flow downstream of the classifying location(s). Successive increments of the flow are converted into successive increments of a stream which carries a surplus of shreds and is trimmed for conversion into a filler which is ready to be wrapped into cigarette paper. The comminuted ribs are admitted into the flow at a location such that they are confined in the central portion of the filler.

26 Claims, 5 Drawing Sheets

METHOD OF AND APPARATUS FOR SEPARATING FOREIGN OBJECTS FROM MOVING TOBACCO PARTICLES IN A ROD MAKING MACHINE

CROSS-REFERENCE TO RELATED CASE

The method and apparatus of the present invention constitute improvements over and further developments of method and apparatus which are disclosed in the commonly owned copending patent application Ser. No. 07/613,201 filed Nov. 8, 1990 by Uwe Heitmann for "Method of and apparatus for making a tobacco stream with a core containing tobacco ribs", now U.S. Pat. No. 5,148,816.

BACKGROUND OF THE INVENTION

The invention relates to improvements in methods of and in apparatus for making tobacco rods, for example, for making tobacco rods wherein a rod-like filler of natural, substitute and/or reconstituted tobacco is confined in a tubular wrapper of cigarette paper or other suitable wrapping material and which is ready to be subdivided into rod-shaped articles of the tobacco processing industry. More particularly, the invention relates to improvements in the treatment of tobacco particles on the way toward the stream and rod forming stations of a cigarette rod making or like machine. Still more particularly, the invention relates to improvements in methods of and in apparatus for treating tobacco ribs and foreign objects which happen to be admixed to more valuable combustible tobacco smoke generating constituents of rod-shaped smokers' products.

A modern cigarette rod making machine can produce one or more elongated rods which contain tobacco and are ready to be draped into cigarette paper or other suitable wrapping material prior to advancement through one or more cutters, one for each rod and each having means for subdividing the respective rod into sections of unit length or multiple unit length. The machine has at least one so-called distributor (sometimes called hopper) which converts a mixture of tobacco particles into a loose flow that is ready to be converted into a stream containing a surplus of tobacco particles. The surplus is removed by a so-called trimming or equalizing device, and the thus obtained trimmed stream or filler is condensed and draped into wrapping material to form a rod which is ready for subdivision into rod-shaped smokers' products. Conversion of the flow into a stream normally involves the utilization of an endless foraminous conveyor which cooperates with a suction chamber to attract successive increments at the leading end of the advancing flow and to form successive increments of a stream which contains the afore-discussed surplus.

Satisfactory treatment of tobacco particles in the distributor and during and subsequent to conversion of a loose flow of such particles into a stream is important because it greatly influences the quality of the ultimate products, e.g., plain cigarettes or filter cigarettes. For example, it is important to avoid excessive comminution of shredded tobacco leaf laminae because this could result in the generation of high percentages of short tobacco and tobacco dust. Furthermore, it is important to avoid excessive drying or moisturizing of tobacco particles. Still further, it is important to prevent relatively heavy, bulky and hard (sharp) fragments of tobacco ribs from puncturing the wrapping material for the tobacco filler. It is also important to ensure that the filler exhibit a desirable hardness as well as that particles of tobacco ribs be distributed in the filler in such a way that they are not likely to develop into relatively large glowing embers which are likely to fall out of the lighted end of a smokers' product to burn a hole in the floor and even set the surrounding area on fire.

Foreign particles, such as pieces of wire, nails, screws, bolts, nuts and/or plastic material, are also likely to find their way into the loose flow of tobacco particles and thence into the stream to thereby affect the quality of the cigarettes or other rod-shaped smokers' products.

OBJECTS OF THE INVENTION

An object of the invention is to enhance the quality of rod-shaped articles of the tobacco processing industry.

Another object of the invention is to provide a novel and improved method of improving the quality of advancing accumulations of smokable material which are to be converted into the filler or fillers of one or more rods in a single or multiple tobacco rod making machine.

A further object of the invention is to provide a novel and improved method of treating fragments of ribs in and downstream of the distributor in a machine for the making of one or more continuous tobacco rods.

An additional object of the invention is to provide a novel and improved method of removing foreign objects from particles which are to form the filler or fillers of one or more tobacco rods.

Still another object of the invention is to enhance the uniformity of distribution of various smokable constituents in a tobacco rod.

A further object of the invention is to provide a novel and improved method of treating fragments of tobacco ribs simultaneously with the manipulation of foreign objects which are to be segregated from tobacco particles Another object of the invention is to provide a novel and improved method of preventing relatively hard and/or sharp particles of tobacco and/or other material from affecting the integrity of wrapping material for tobacco fillers.

Still another object of the invention is to provide a method of enhancing the hardness of tobacco fillers.

An additional object of the invention is to provide a method of reducing the likelihood of escape of glowing embers from the lighted ends of rod-shaped smokers' products.

A further object of the invention is to provide a novel and improved apparatus for the practice of the above outlined method.

Another object of the invention is to provide an apparatus which can employ existing distributors or hoppers of the type often employed in machines for producing discrete or plural tobacco rods.

An additional object of the invention is to provide an apparatus which can be installed in existing cigarette rod making and like machines.

Still another object of the invention is to provide the apparatus with novel and improved means for treating fragments of tobacco ribs.

A further object of the invention is to provide an apparatus which can reliably segregate foreign particles from shreds of tobacco leaf laminae and from fragments of tobacco ribs.

An additional object of the invention is to provide the above outlined apparatus with novel and improved means for comminuting fragments of tobacco ribs.

An additional object of the invention is to provide the apparatus with novel and improved means for manipulating fragments of tobacco ribs on their way from the magazine of a distributor toward the stream forming station of a machine for the making of discrete or plural tobacco rods.

Another object of the invention is to provide the apparatus with novel and improved means for preventing fragments of tobacco ribs from puncturing and/or otherwise affecting the integrity and/or appearance of wrapping material for cigarette rods.

A further object of the invention is to provide the apparatus with novel and improved means for transporting relatively large, medium sized and relatively small fragments of tobacco ribs through a series of treating stations on their way toward the stream forming station of a rod making machine.

An additional object of the invention is to provide a rod making machine which embodies or is combined with the above outlined apparatus.

Another object of the invention is to produce high-quality rod-shaped articles of the tobacco processing industry.

SUMMARY OF THE INVENTION

One feature of the present invention resides in the provision of a method of making at least one stream of first and second tobacco particles (such as lightweight shreds of tobacco leaf laminae and relatively heavy fragments of tobacco ribs). The improved method comprises the steps of accumulating the first and second particles, together with randomly distributed foreign particles which are normally heavier than the second particles, into an elongated flow of particles and advancing the flow along a predetermined path, segregating the second and foreign particles from the flow in at least one predetermined portion of the path, thereupon separating the second particles from foreign particles, thereafter comminuting at least some of the separated second particles, converting successive increments of the advancing flow—in a second portion of the path downstream of the at least one first portion—into an elongated stream having an outer portion and an inner portion which is surrounded by the outer portion, and effecting the introduction of at least some comminuted second particles into the inner portion of the elongated stream. This last step includes admitting the at least some comminuted second particles into the path between the first and second portions.

The method further comprises the step of transporting the elongated stream away from the second portion along a second path which preferably extends transversely of the predetermined path.

If the foreign particles are heavier than the second particles (or vice versa), the separating step preferably includes separating the second particles from foreign particles by sieving or sifting.

As a rule, the second particles will include particles of different sizes and/or shapes, and the comminuting step preferably includes (or can include) jointly comminuting separated second particles irrespective of their sizes and/or shapes.

The inner portion of the elongated stream includes the center of such stream, and the aforementioned introduction effecting step preferably includes effecting the introduction of at least some comminuted second particles into the flow at least close to the center of the elongated stream.

In accordance with a presently preferred embodiment of the method, the comminuting step includes cutting the at least some separated second particles.

If the second and foreign particles are heavier than the first particles, the segregating step preferably includes pneumatically separating at least a majority of first particles from the second and foreign particles.

The first particles can include or constitute tobacco shreds, the second particles can constitute portions or fragments of tobacco ribs, and the foreign particles can include metallic and/or plastic objects (e.g., pieces of wire, nails, bolts, screws and/or nuts).

The converting step can include transforming the flow into an elongated stream which contains a surplus of first particles, and such method preferably further comprises the step of removing the surplus from the elongated stream so that the thus obtained trimmed or equalized stream constitutes a filler which is ready to be draped into a web of cigarette paper or other suitable wrapping material.

Another feature of the invention resides in the provision of an apparatus for making a stream of first and second tobacco particles. The improved apparatus comprises means for accumulating first and second particles and randomly distributed foreign particles into an elongated flow of particles, and such accumulating means includes means for advancing the flow in a predetermined direction along a predetermined path. The apparatus further comprises means for segregating second and foreign particles from the flow in at least one first portion of the path, means for separating segregated second particles from segregated foreign particles, means for comminuting at least some separated second particles, means for converting successive increments of the advancing flow—in a second portion of the path downstream of the at least one first portion—into an elongated stream having an outer portion and an inner portion which is surrounded by the outer portion, and means for effecting the introduction of at least some comminuted second particles into the inner portion of the elongated stream. The last named means comprises means for admitting the at least some comminuted second particles into the path between the first and second portions of such path. The converting means preferably comprises means (such as an elongated foraminous endless conveyor and a suction chamber next to the conveyor) for transporting the elongated stream along a second path in a second direction transversely of the predetermined path. The second portion of the predetermined path is preferably adjacent the transporting means and includes an upstream end and a downstream end (as seen in the second direction), and the admitting means preferably includes means for returning at least some comminuted second particles into the predetermined path at a location such that the returned comminuted second particles reach the second portion of the predetermined path intermediate the upstream and downstream ends of the second portion.

The separating means can comprise a pneumatic sifting device, especially if the weight of second particles departs from the weight of foreign particles.

The comminuting means can comprise a rotary cutting device which actually severs the second particles prior to readmission of at least some (comminuted) second particles into the flow. The cutting device can comprise a stator member and a rotor member which surrounds the stator member. The two members define a first chamber for reception of second particles from the separating means and a further chamber which discharges comminuted second particles. The cutting device can further comprise means for pneumatically evacuating comminuted second particles from the further chamber. To this end, the further chamber is provided with an inlet and an outlet, and the evacuating means can comprise a conduit extending through the stator member and connecting the inlet of the further chamber with the atmosphere, and an ejector which draws comminuted second particles from the further chamber through the outlet. The stator member can comprise a plurality of cutting arms (e.g., at least three cutting arms) for second particles. Each of the two members of the cutting device can comprise a plurality of cutting elements which are spaced apart from each other in the axial direction of the rotor member. Each cutting element of the stator member cooperates with a cutting element of the rotor member to sever second particles in and/or between the first and further chambers. The apparatus can further comprise a conduit which connects an outlet of the separating means with an inlet (such as the aforementioned first chamber) of the cutting device. An ejector can be provided in the conduit to promote the transfer of separated second particles from the outlet of the separating means into the inlet of the cutting device.

Alternatively, the just discussed ejector can be replaced with means for pneumatically conveying separated second particles from the outlet or outlets of the separating means to the comminuting means, such as the aforementioned rotary cutter. The means for pneumatically conveying can include a centrifugal separator having an inlet connected with the outlet of the separating means to receive separated second particles in a gaseous carrier medium (e.g., air), a first outlet for admission of separated second particles into the inlet of the comminuting means (e.g., into the first chamber of the rotary cutter), and a second outlet for gaseous carrier medium. Such apparatus can further comprise a gate (e.g., a rotary cell wheel) which is disposed between the first outlet of the centrifugal separator and the comminuting means to permit passage of second particles but to intercept the gaseous carrier medium. The second particles are comminuted in the first chamber and/or in the further chamber and/or between these chambers. The comminuting means can further comprise a housing which receives the rotor member, and the latter can define with the stator member an annular clearance for evacuation of gaseous carrier medium for second particles from the comminuting means. The means for pneumatically evacuating comminuted second particles from the further chamber delivers the second particles into the predetermined path, and the aforementioned annular clearance between the stator member and the rotor member can include an enlarged portion which is disposed at the further chamber and serves to withdraw gaseous carrier medium from the comminuting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
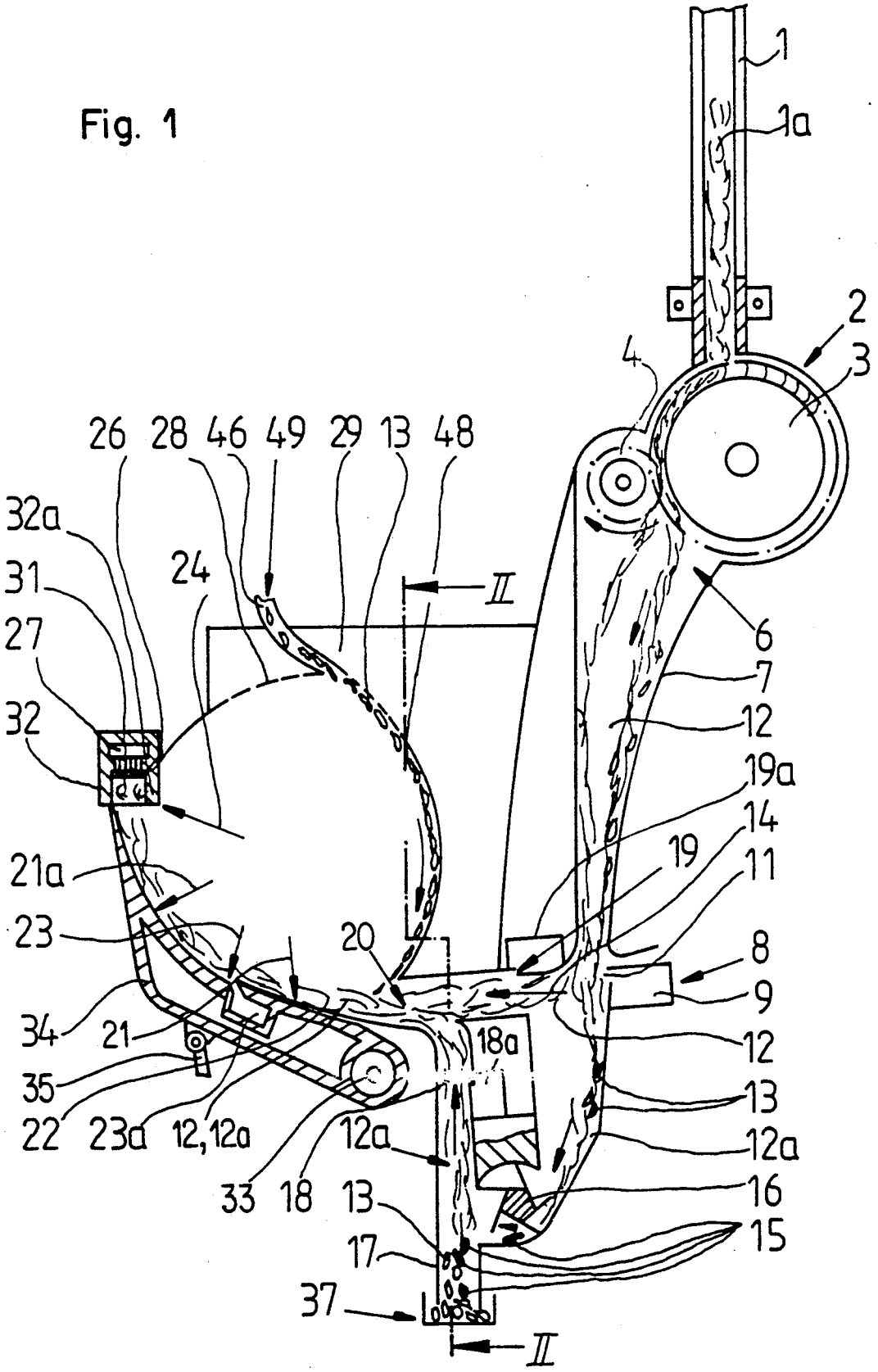
FIG. 1 is a fragmentary partly elevational and partly vertical sectional view of an apparatus which embodies one form of the invention and is designed for use in a machine for making a single tobacco filler.

FIG. 1 shows a portion of a cigarette rod making machine of the type described and shown, for example, in commonly owned U.S. Pat. No. 4,998,540 (granted Mar. 12, 1991 to Brand for "Method of and apparatus for eliminating irregularities from a stream of fibrous material") and U.S. Pat. No. 5,072,742 granted Dec. 17, 1991 to Heitmann for "Method of and apparatus for making a filler of smokable material"). The disclosures of these patents are incorporated herein by reference. Reference may also be had to German Pat. No. 27 29 730. More specifically, FIG. 1 shows a portion of a distributor (also called hopper) which is used in a rod making machine to accumulate first tobacco particles 12 and **12*a* (such first particles normally or often constitute shreds of tobacco leaf laminae and will be called shreds for short), second tobacco particles 13 (such particles normally or often constitute fragments of tobacco ribs and will be called ribs for short) and randomly distributed foreign particles 15 (such particles can include pieces of wire, nails, bolts, screws, nuts, pieces of plastic material, pieces of wood, textile fibers and/or others and hereinafter called objects or foreign objects) into a continuous flow 22 of loosely assembled and/or interlaced particles. The initial stage of the flow 22 is a shower 6** which is drawn from an upright column la of randomly intermixed shreds, ribs and foreign objects in a gathering duct 1 above a withdrawing and showering unit 2. The unit 2 comprises a driven carded wheel or drum 3 immediately beneath the open lower end of the gathering duct 1 and a rapidly rotating picker roller 4 which expels shreds, ribs and foreign objects from the carding of the drum 3 and converts them into the shower 6. This shower descends by gravity and under the action of the picker roller 4 in a downwardly tapering funnel-shaped gravity flow duct 7 into the range of a pneumatic classifying device 8 which segregates the ribs 13 and the foreign objects 15 from the shreds 12 whereby the shreds remain in the flow 22 but the ribs and foreign objects are free to enter the lower portion of the duct 7 and into the range of a rotary gate 16 in the form of a so called cell wheel. The ribs 13 and foreign objects 15 (the number of such foreign objects is exaggerated in FIG. 1 for the sake of clarity) normally entrain a certain percentage of shreds 12 (the entrained shreds are denoted by the characters 12*a*), and the mixture including the particles 12*a*, 13 and 15 is caused to enter the lower portion of an upright duct 17.

The segregating or classifying device 8 comprises at least one plenum chamber 9 and one or more nozzles 11 having orifices which discharge streamlets or jets of a compressed gaseous fluid (normally air) in the direction of arrow 14. The streamlets or jets are capable of entraining the shreds 12 but not the ribs 13 and not the normally relatively heavy foreign objects 15, i.e., the ribs and the foreign objects (together with the entrained shreds 12*a*) are capable of penetrating through the curtain of compressed air issuing from the orifice(s) of the nozzle(s) 11 to advance toward and through the gate 16 and into the duct 17. The ribs 13 and the foreign objects 15 descend in the duct 17 to enter a vibratory conveyor 37 serving to advance the ribs and the foreign objects in the direction of arrow 36 (see FIG. 2). The entrained shreds 12*a* rise in the duct 17 under the injector effect of one or more nozzles 18 having orifices which discharge ascending jets or streamlets of compressed gaseous fluid (normally air) which is confined in a plenum chamber 18*a*. This causes the shreds 12*a* to return into the flow 22 downstream of an accelerating device for shreds 12. Such accelerating device includes a further plenum chamber 19*a* with one or more nozzles 19 having orifices which discharge streamlets or jets of compressed gaseous fluid (hereinafter called air) in the direction of arrow 14. The location where the shreds 12*a* are caused to merge into the flow 22 of shreds 12 is indicated at 20.

The upper end of the gathering duct 1 can receive batches of shreds 12, 12*a* mixed with ribs 13 and foreign objects 15 from a suitable conveyor (e.g., an 10 elevator conveyor) which draws a mixture of particles 12, 12*a*, 13 and 15 from a suitable magazine of the distributor. Reference may be had to the aforementioned U.S. Pat. No. 5,072,742 to Heitmann which further shows means for supplying particles to the magazine of the distributor.

The shreds 12 and 12*a* which are mixed at 20 together form a modified flow and are advanced onto and along the concave upper side of a guide 21. The means for advancing comprises the nozzle or nozzles 11 of the segregating or classifying device 8, the nozzle or nozzles 19 of the plenum chamber 19*a*, the nozzle or nozzles 23 of a further plenum chamber 23*a* beneath the guide 21 and, if necessary, one or more additional nozzles or other suitable advancing means (not shown). The flow of shreds 12 and 12*a* which advance along the elongated path defined in part by the concave upper side of the guide 21 is or can be relatively wide, and the shreds are loosely intermixed and form a so-called wall stream which also contains a gaseous carrier medium (air) and closely hugs the upper side of the guide 21.

Figure 2:
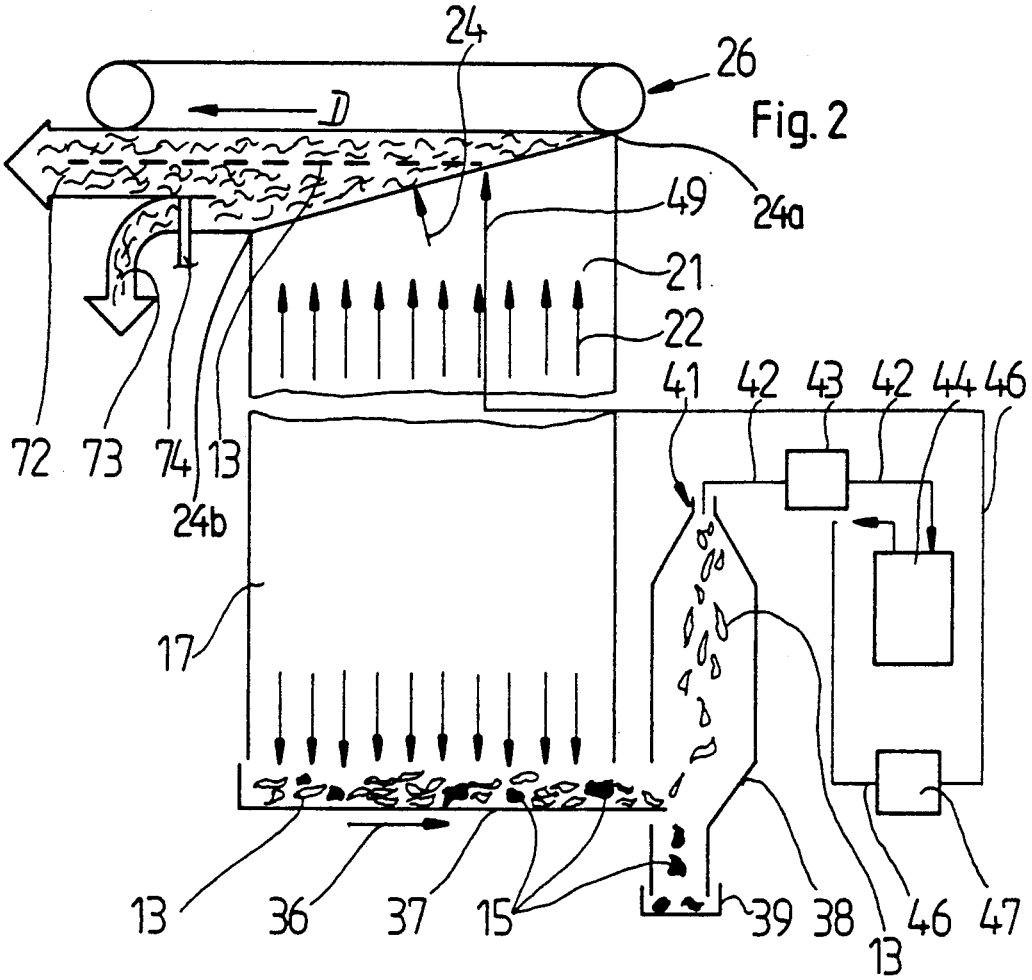
FIG. 2 is a diagrammatic partly elevational and partly sectional view of the improved apparatus, the section being taken in the direction of arrows substantially as seen from the line II—II in FIG. 1.

The segregating device 8 is adjacent a first portion of the elongated path for the elongated flow 22 which starts as the shower 6 and successive increments of which are converted into successive increments of a continuous stream in a second portion 24 of such elongated path, namely at the underside of the lower end of an endless foraminous belt 26. The belt 26 forms part of a means for transporting the stream along a second elongated path transversely of the elongated path for the flow 22, and the direction of advancement of the stream is indicated by an arrow D (FIG. 2). The transporting means for the stream further comprises a suction chamber having an open or permeable underside or bottom wall adjacent the upper side of the lower reach of the foraminous belt 26.

The second portion 24 of the elongated path for the flow 22 constitutes a stream building zone having an upstream end 24*a* and a downstream end 24*b* (as seen in the direction of the arrow D). The suction chamber 27 attracts the stream to the underside of the lower reach of the foraminous belt 26 and ensures that the stream which is fully grown at the end 24*b* of the zone 24 continues to advance in the direction of arrow D. The surplus of gaseous carrier medium for the flow 22 escapes through a filter 28 to enter an expansion chamber 29.

The lower reach of the foraminous belt 26 advances in a tobacco channel 31 which has downwardly extending sidewalls or cheeks 32, 32*a* and accommodates the stream building zone 24. The guide 21 includes a stationary portion of sheet metal or the like beneath the location 20 and a leading or front portion 21*a* forming part of a lever or flap 34 which is pivotable at 33 and carries the aforementioned plenum chamber 23*a* with nozzle or nozzles 23. The lever 34 can be pivoted by a link 35 so as to move the portion 21*a* out of the way and afford access to the main portion of the guide 21 in the event of disturbances and/or for other reasons. The tip of the front portion 21*a* is preferably aligned with one of the sidewalls or cheeks 32, 32*a* to ensure predictable entry of successive increments of the flow 22 into the channel 31, i.e., into the stream building zone 24.

Figure 3:
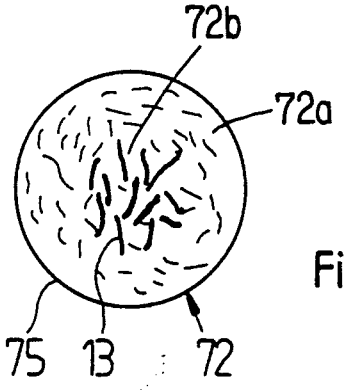
FIG. 3 is an enlarged transverse sectional view of a wrapped tobacco filler which can be produced in a machine employing the apparatus of FIGS. 1 and 2.

The vibratory conveyor 37 advances the mixture of segregated ribs 13 and foreign objects 15 in the direction of arrow 36 and into a pneumatic separating device or sifter 38. As a rule, the foreign objects 15 are heavier than the ribs 13 so that they descend into a collecting receptacle 39 (which can constitute a conveyor) and are evacuated from the rod making machine in a manner not forming part of the invention. The separated ribs 13 ascend into the outlet 41 at the upper end of the separating device 38 and are entrained into the inlet of a comminuting device 44 through a conduit 42 which contains a pneumatic ejector 43. The illustrated comminuting device 44 is or includes a rotary cutter which actually severs the ribs 13 (such ribs can include larger, medium sized and smaller ribs), and the outlet of the cutter 44 is caused to effect the introduction of comminuted (cut) ribs 13 into or close to a central or inner portion 72*b* of a rod-like filler 72 (see FIG. 3) which remains upon removal of a surplus 73 from the stream (72+73) which is formed in the stream building zone 24 and is transported by the belt 26 (in cooperation with the suction chamber 27) in the direction of arrow D. The means for effecting such introduction of the cut ribs 13 into the flow 22 (at or at least slightly downstream of the location 20 for introduction of shreds 12a) includes a conduit 46 whose inlet is connected with the outlet of the cutter 44 and which contains a second pneumatic ejector 47. The latter is or can be identical with the ejector 43 in the conduit 42 between the separating device 38 and the inlet of the cutter 44.

The conduit 46 discharges a streamlet of comminuted ribs 13 against the concave side of a second guide 48 which is installed above the guide 21 and directs the streamlet of cut ribs toward and into the path for the flow 22 at or downstream of the location 20 for introduction of the shreds 12a. The guide 48 admits the cut ribs 13 into the flow 22 between the marginal portions of the flow, namely at a location such that when the cut ribs come relatively close to the underside of the lower reach of the foraminous belt 26, they enter the growing stream between the upstream end 24a and the downstream end 24b of the stream building zone 24 (second portion of the path for the flow 22). The arrangement is preferably such that the comminuted ribs 13 enter the center or close to the center of that (major) portion of the stream 72+73 which continues to adhere to the lower reach of the belt 26 upon removal of the surplus 73 by a suitable trimming or equalizing device 74. This ensures that the cut ribs 13 are confined in the central portion of the trimmed stream or filler 72 and are completely surrounded by the outer portion 72a of such filler. The latter is thereupon draped into a web of cigarette paper 75 (FIG. 3) or other suitable wrapping material to form a cigarette rod which is ready to be subdivided in a so-called cutoff to yield a series of plain cigarettes of unit length or multiple unit length. The thus obtained plain cigarettes can be transported to storage, into the magazine of a packing machine or into a filter tipping machine if the ultimate products are to constitute filter cigarettes. Reference may be had to commonly owned U.S. Pat. No. 4,538,626 (granted Sep. 3, 1985 to Hinzmann for "Apparatus for trimming a tobacco stream") which describes and shows the manner of treating the rod-like tobacco filler in a cigarette rod making machine.

The locus of introduction of cut ribs 13 into the growing stream of shreds 12, 12a at the underside of the lower reach of the foraminous belt 26 is indicated in FIG. 1 by an arrow 49. Such selection of this locus ensures that the cut ribs 13 enter the partly grown stream 72+73, i.e., that the ribs enter the stream growing zone 24 at a selected level beneath the lower reach of the belt 26. This, in turn, ensures that the cut ribs 13 are ultimately confined in or at least close to the center of the tobacco filler 72. Such mode of introducing the cut ribs 13 reduces the likelihood of damage to the wrapping material 75 (which is contacted only by the 10 relatively soft and readily pliable shreds 12 and/or 12a of the outer portion 72a) and enhances the hardness of the filler 72. Since the level of the trimming device 74 and the level of the lower reach of the belt 26 are known, it is readily possible to select the locus of admission of cut ribs 13 into the flow 22 (at or close to the location 20) in such a way that the cut ribs reach the stream building zone 24 at a level whose distance from the level of the lower reach of the belt 26 equals or approximates half the diameter of the filler 72.

Figure 4:
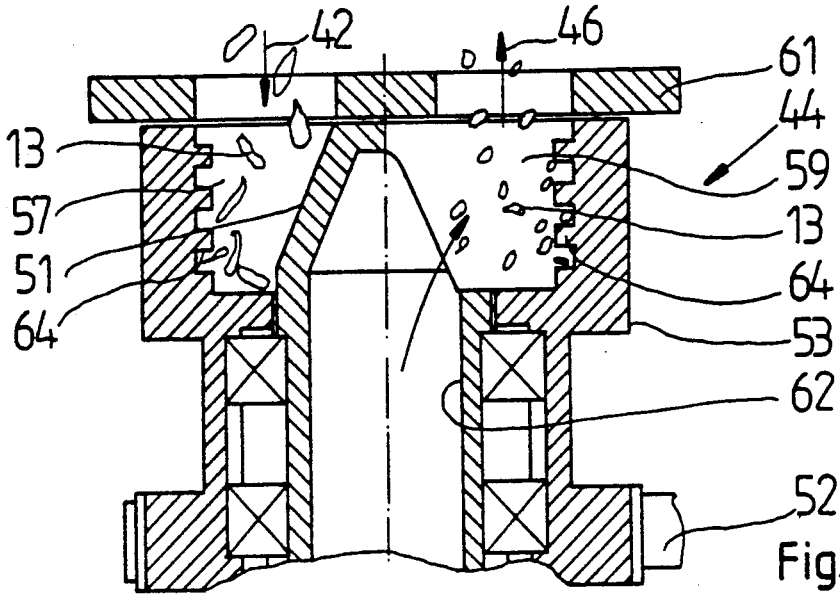
FIG. 4 is a fragmentary central vertical sectional view of a device which can be utilized to comminute fragments of tobacco ribs prior to readmission of such ribs into the flow of tobacco particles.
Figure 5:
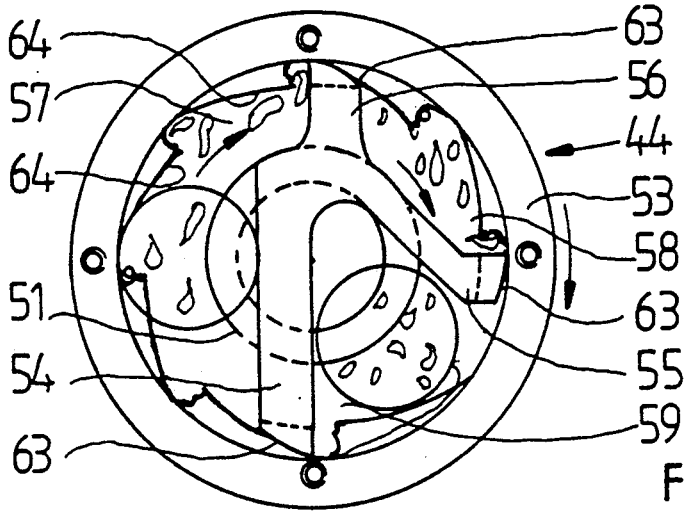
FIG. 5 is a plan view of the structure which is shown in FIG. 4.

The cutter 44 for ribs 13 which are supplied by the conduit 42 and ejector 43 is shown in FIGS. 4 and 5. This cutter comprises an upright stationary member or stator member 51 and a rotary member or rotor member 53 which surrounds the stator member and has a pulley driven by an endless belt 52 to rotate in a clockwise direction (as viewed in FIG. 5). The upper portion of the upright stator member 51 is provided with three circumferentially spaced apart cutting arms or wings 54, 55 and 56 which divide the space between the members 51 and 53 into a first chamber or rib receiving inlet chamber, a further or rib discharging chamber 59 and a chamber 58 between the chambers 57 and 59. The chambers 57 to 59 are adjacent the underside of a cover or lid 61 which has a first opening for admission of separated ribs 13 from the conduit 42 (the latter is indicated in FIG. 4 by a vertical arrow), and a second opening which registers with the further chamber 59 and serves to admit cut ribs 13 into the inlet of the conduit 46. The means for pneumatically evacuating cut ribs 13 from the further chamber 59 comprises a channel or conduit 62 extending centrally through the stator member 51 and connecting the inlet of the chamber 59 with the atmosphere, and the aforementioned pneumatic ejector 47 which is installed in the conduit 46 a draws a gaseous carrier medium (air) and cut ribs 13 through the outlet of the chamber 59, through the conduit 46 and on toward and against the guide 48.

The stator member 51 comprises a plurality (preferably three) cutting elements or segments 63 which are disposed at different levels (i.e., they are spaced apart in the axial direction of the rotor member 53) and each of which cooperates with one of several cutting elements or segments 64 forming part of or affixed to the rotor member 53. The cutting elements 64 cooperate with the corresponding cutting elements 63 to cut all of the ribs 13 which are admitted into the first chamber 57 while the ribs are confined in the chamber 57, while the ribs are confined in the further chamber 59 and/or while the ribs are caused to advance from the chamber 57, through the median chamber 58 and into the further chamber 59. The manner in which the cutting elements 64 of the driven rotor member 53 cooperate with the adjacent cutting elements 63 of the stator member 51 when the belt 52 rotates the pulley of the rotor member 53 will be readily followed by looking at FIG. 5.

Figure 6:
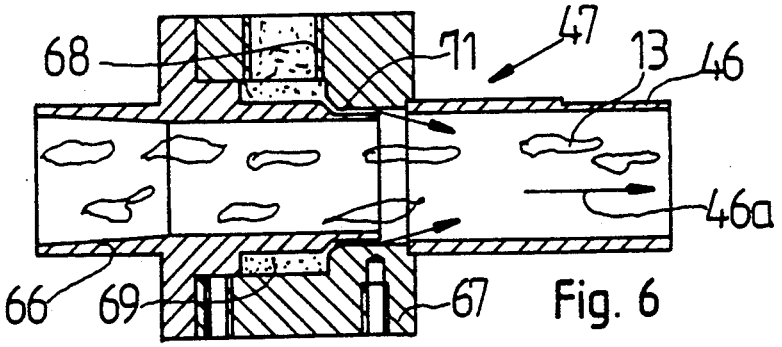
FIG. 6 is an axial sectional view of a pneumatic ejector which can be utilized in the apparatus of FIGS. 1 and 2.

FIG. 6 shows the details of the pneumatic ejector 47. As already mentioned above, the ejector 43 in the conduit 42 is or can be identical with the ejector 47. The latter not only serves to draw ribs 13 from the separating device 38 but preferably further serves as a means for accelerating the separated ribs on their way into the first chamber or inlet 57 of the rotary cutter 44. The ejector 47 of FIG. 6 comprises an elongated inner tube 66 a portion of which is surrounded by a ring-shaped casing or housing 67. The housing or casing 67 is provided with an annular or nearly annular internal plenum chamber 69 which is connected with a source (not shown) of compressed air (e.g., with the outlet of a blower or fan). The inlet of the plenum chamber 69 is shown at 68. The reference character 71 denotes an annular orifice or a set of annularly distributed orifices which discharges or discharge one or more jets of compressed air into the tube 66 so that the jet or jets have a component of movement in the direction of arrow 46a and propel the separated ribs in the conduit 46 into the inlet or first chamber 57 of the rotary cutter 44. The front end of the tube 66 can form an integral part of the housing or casing 67 and can be said to further constitute a portion of the conduit 46.

As far as the treatment of ribs 13 and foreign objects 15 is concerned, the operation of the apparatus which includes the structure of FIGS. 1 to 5 is as follows:

The duct 6 delivers that (initial) portion (6) of the flow 22 which is formed by the withdrawing unit 2 of FIG. 1 and still contains uncut ribs 13 and randomly distributed foreign objects 15 into the range of the nozzle or nozzles 11 which separates or separate the ribs 13 and foreign objects 15 from the shreds 12 by deflecting the shreds 12 which advance in the direction of arrow 14 toward and onto the concave upper side of the guide 21. The ribs 13 and the foreign objects 15 descend in the duct 6 beyond the segregating device 8 and entrain a certain percentage of shreds (12*a*) toward and through the gate 16.

The shreds 12*a* rise in the duct 17 but the ribs 13 and the foreign objects 15 descend into or onto the conveyor 37 and are advanced in the direction of arrow 36 to enter the pneumatic classifying device 38. The ascending current of air which is needed for separation of ribs 13 from the foreign objects 15 in the separating device (sifter) 38 is generated by the ejector 43 in the conduit 42 so that the ribs 13 leave the separating device 38 through the outlet 41 and advance in the conduit 42 toward and into the inlet or first chamber 57 of the rotary cutter 44. The normally heavier foreign objects 15 descend in the separating device 38 to accumulate in the collecting receptacle 39 and to be evacuated, either at intervals or continuously.

The belt 52 drives the rotor member 53 of the cutter 44 so that the cutting elements 64 of the rotor member cooperate with the adjacent cutting elements 63 of the stator member 51 and cut the ribs 13 of all sizes and shapes to a desired reduced size while the ribs advance from the chamber 57 toward and into the further chamber 59. The provision of an additional chamber 58 between the chambers 57 and 59 (as seen in the direction of advancement of ribs 13 through the rotary cutter 44) contributes significantly to reliability of the cutting action, i.e., the cutting elements 64 cooperate with the adjacent cutting elements 63 to cut all or practically all ribs not later than when the cut ribs reach the outlet of the chamber 59 and thence the inlet end of the conduit 46. The ejector 47 in the conduit 46 draws a current of gaseous carrier medium from the atmosphere through the conduit or channel 62 so that the freshly cut ribs 13 are compelled to advance toward a selected portion of the advancing flow 22 (at the location 20) and are caused to advance with the flow 22 along the front portion 21*a* of the guide 21 and into the tobacco channel 31 to reach the stream building zone 24 between the leading and trailing ends 24*a*, 24*b* as fully described hereinbefore. The cut ribs 13 which enter the stream 72+73 of shreds 12, 12*a* are thereupon confined or concealed by shreds 12, 12*a* which enter the stream building zone 24 downstream of the locus of admission of cut ribs, i.e., by those shreds 12, 12*a* which reach the stream building zone 24 between the tip of the arrow 49 and the downstream end 24*b* (as viewed in FIG. 2). The surplus 73 is thereupon removed by the trimming device 74 and the thus obtained filler 72 is ready to be draped into a web of cigarette paper 75 or other suitable wrapping material. Since the comminuted or cut ribs 13 are located at the center of the filler 72, they are less likely to fall (in the form of glowing embers) out of the lighted end of a cigarette which is obtained by subdividing the wrapped filler 72 into sections of desired length. This constitutes an additional feature of effecting introduction of cut ribs 13 into the center of the filler 72. Other advantages are that the ribs 13 are highly unlikely to puncture and/or otherwise damage or affect the appearance of the wrapper 75, and that the ribs 13 enhance the hardness of the filler 72. It has been found that the hardness of the filler 72 is improved (increased) considerably if the cut ribs 13 are caused to enter the center of the filler, i.e., the inner portion 72*b* which is surrounded by the outer portion 72*a* and only thereafter by the tubular wrapper 75.

An important advantage of the improved method and apparatus is that the foreign objects 15 are reliably expelled from the flow which contains shreds 12 in good time before they could reach the stream building zone 24. Furthermore, any foreign objects 15 which happen to enter the gathering duct 1 are segregated from the shreds 12 and thereupon separated from the ribs 13 in good time before they could cause extensive damage to more sensitive components of the rod making machine, e.g., to the trimming device 74, before they could enter hard-to-reach parts of the machine, and before they could enter and thus adversely affect the quality of the filler 72. As a rule, foreign objects will enter the distributor of a rod making machine due to lack of attentiveness on the part of attendants. Since the foreign objects are normally heavier than the ribs 13, they can be readily separated from the ribs in a pneumatic sifter which permits the foreign objects to descend and causes or permits the relatively lightweight ribs 13 to rise and to be entrained or propelled into the comminuting device 44.

Another advantage of the improved method and apparatus is that segregation of foreign objects 15 from the shreds 12 can be utilized for another desirable purpose, i.e., to comminute the ribs 13 ahead of the stream building zone 24. This is accomplished by the aforediscussed novel expedient of segregating the foreign objects 15 from the shreds 12 together with the ribs 13, by thereupon separating the ribs 13 from the foreign objects 15, by thereupon comminuting (preferably cutting) the separated ribs 13, and by thereupon reintroducing the cut ribs into the flow of shreds 12. As mentioned above, the comminuting or cutting action is preferably carried out in such a way that the device 44 can comminute (preferably cut) large or relatively large ribs 13 jointly with medium-sized as well as small ribs, i.e., that all ribs which are segregated at 8 are cut to desired size prior to reintroduction into the flow 22 at or downstream of the location 20. Cutting (e.g., in lieu of crushing) of the ribs 13 has been found to be more satisfactory if the ribs are to be reintroduced into the flow 22, i.e., if they are permitted or caused to enter the stream building zone 24 in the tobacco channel 31. Cut ribs are normally less likely to exhibit numerous sharp edges which would be apt to affect the quality and/or the appearance of the tubular wrapper which surrounds the tobacco filler (72) in a finished cigarette rod.

The rotary cutter 44 exhibits the advantage that the quality of cut ribs is more satisfactory than the quality of ribs which are comminuted in a different way, for example, in a crusher. Moreover, the cutter 44 is compact but can nevertheless cut the segregated and separated ribs at a rate which is required in a modern rod making machine. The stator 51 separates the chambers 57, 59 from each other and is surrounded by the rotor 53 to contribute to compactness of the cutter 44. The ejectors 43 and 47 contribute to reliable transport of uncut ribs from the separating device 38 into the cutter 44 and from the cutter to the guide 48. The provision of a stator member with several (preferably not less than three) cutting arms 54–56 contributes to the quality of the cutting action and ensures that the cutter 44 can comminute a large quantity of ribs per unit of time. Thus, the plural cutting arms practically ensure that all of the ribs 13 which are supplied via conduit 42 are comminuted prior to entering the conduit 46. The provision of several cutting elements 63, 64 at different levels, as seen in the axial direction of the rotor member 53, also contributes to more predictable and more satisfactory cutting action.

A further advantage of the improved method and apparatus is that foreign objects 15 are segregated from shreds 12 at a relatively late stage of advancement of shreds through the distributor and on to the stream building zone 24. This is desirable because the segregation of foreign particles is more reliable, i.e., such segregation involves removal of foreign particles which were admitted into the distributor as well as removal of foreign particles which are admixed to the shreds 12 in the distributor proper.

The feature that the cut ribs 13 are admitted into the central portion **72*b* of the filler 72 ensures that the quality (hardness) of the filler is improved to a considerable degree. In addition, such mode of introducing and confining cut ribs in the filler contributes to more satisfactory combustibility of the tobacco-containing portions of cigarettes or other rod-shaped smokers' products which are obtained by subdividing the filler and, as already mentioned above, the cut ribs 13 in the central or inner portion 72*b* of the filler 72** are less likely to constitute relatively large glowing embers which could leave the lighted end of a smokers' product by gravity and damage the carpet or the floor or the garment of the smoker or even constitute a fire hazard.

Still another advantage of the improved method and apparatus is that all parts of the tobacco mass which is admitted into the distributor are processed for introduction into the filler 72 without affecting the appearance and/or quality of the smokers' products. This results in substantial savings in tobacco.

Figure 7:
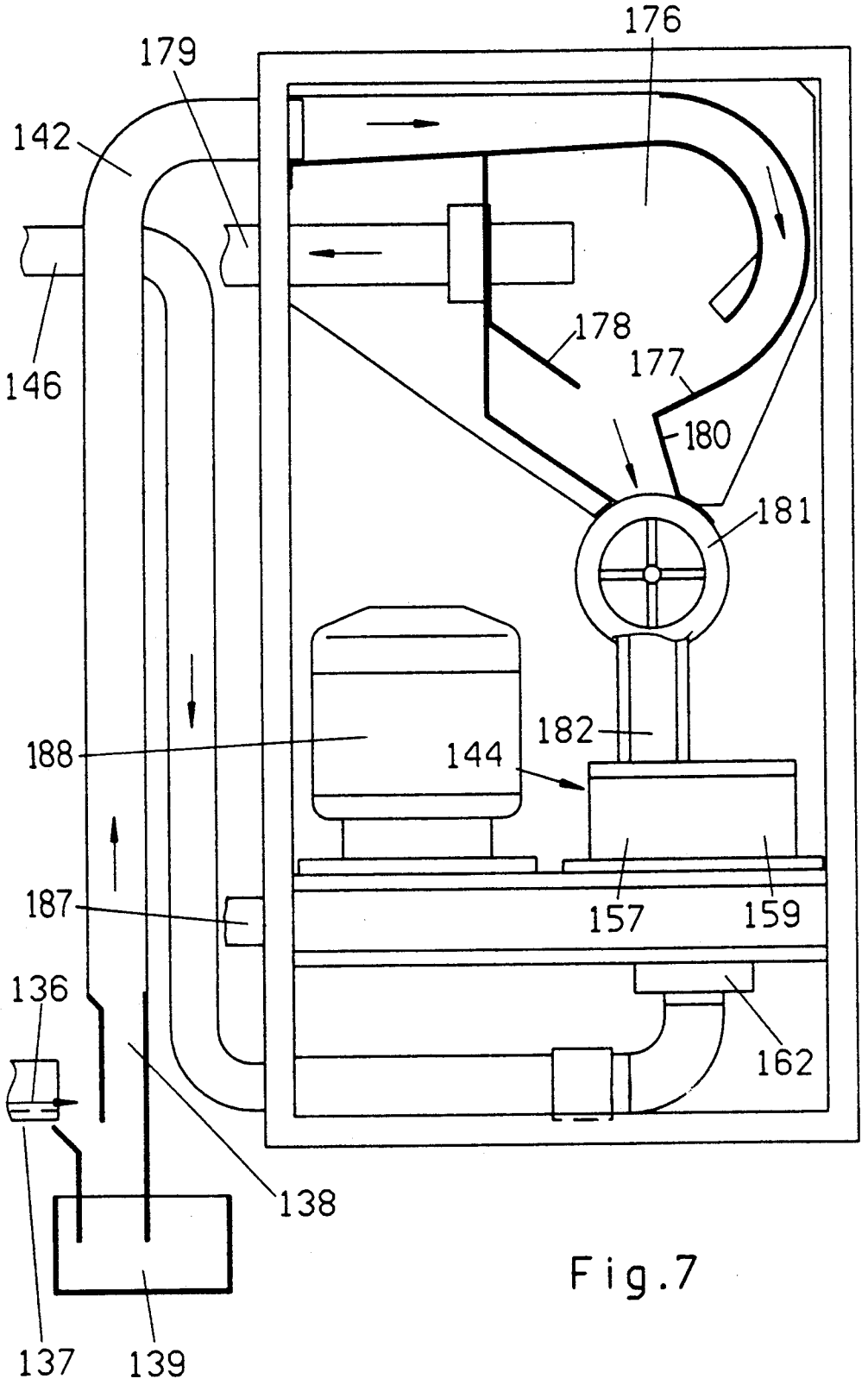
FIG. 7 is a schematic partly elevational and partly sectional view of certain devices in a modified apparatus wherein the separated fragments of tobacco ribs are conveyed into the comminuting device by a centrifugal separator.
Figure 9:
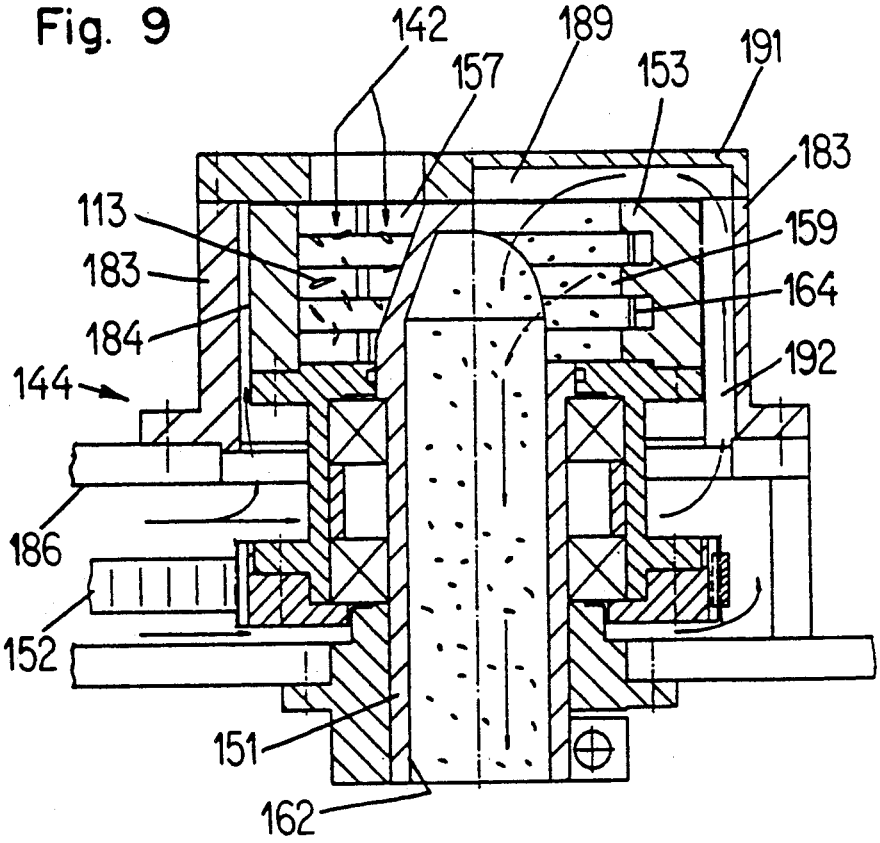
FIG. 9 is a sectional view substantially as seen in the direction of arrows from the line IX—IX in FIG. 8.
Figure 8:
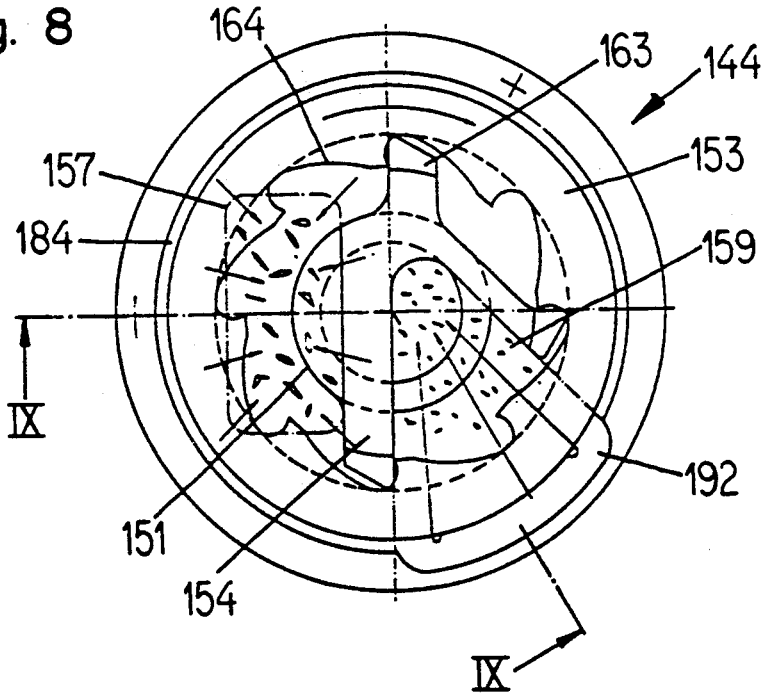
FIG. 8 is a plan view of a modified comminuting device which can be utilized with advantage to receive fragments of separated tobacco ribs from the centrifugal separator of FIG. 7.

FIGS. 7, 8 and 9 show a portion of a modified apparatus. All such parts of this modified apparatus which are identical with or clearaly analogous to corresponding parts of the apparatus of FIGS. 1 to 5 are denoted by similar reference characters plus 100.

In order to establish a balanced pneumatic equilibrium, separated but yet to be comminuted ribs 113 are drawn from the separating device 138 through the conduit 142 by a centrifugal separator 176 which replaces the ejector 43 and has an inlet (conduit 142) connected with the outlet at the upper end of the separating device 138, a first outlet in the form of an opening 180 for evacuation of entrained separated ribs, and a second outlet in the form of a pipe 179 which serves to exhaust the gaseous carrier medium (air). The pneumatic separator 176 further comprises a curved guide vane 177 which directs the advancing separated ribs 113 beneath a baffle 178 so that the ribs are compelled to descend into the outlet opening 189 whereas the carrier medium enters the intake end of the outlet pipe 179. The discharge end of the pipe 179 is connected with a suction generating device, e.g., a blower or fan which can further serve to draw air from the suction chamber 27 of the means for transporting the stream 72+73 in the direction of arrow D.

The outlet opening 180 discharges the ribs 113 by gravity flow into a gate 181 in the form of a cell wheel which intercepts the gaseous carrier medium but admits the ribs into an upright pipe 182 leading to the inlet of the comminuting device 144, preferably a rotary cutter of the type shown in FIGS. 8 and 9. The pipe 182 admits separated ribs 113 into the first chamber 157 of the cutter 144. The latter further comprises a housing or casing 183 which surrounds the rotor member 153 and defines with the latter a relatively narrow annular clearance 184. This clearance communicates with a plenum chamber 186 receiving compressed gaseous carrier medium through a supply conduit 187. The chamber 186 receives a portion of the endless belt 152 which drives the rotor member 153.

The top of the casing or housing 183 carries a cover or lid 191 having an opening for admission of separated but uncut ribs via conduit 142. Furthermore, the cover or lid 191 defines a portion 189 of the conduit or channel 162 which extends axially of the stator member 151 to establish a current of gaseous carrier medium which entrains cut ribs 113 from the further chamber 159. The clearance 184 includes an enlarged portion 192 which is adjacent the further chamber 159 and connects the plenum chamber 186 with the portion 189 of the channel or conduit 162. Thus, compressed air can flow from the plenum chamber 186 into the further chamber 159 via clearance 184 and its enlarged portion 192, and from the chamber 159 (with freshly cut ribs 113) axially through the stator member 151 into the conduit 146 of FIG. 7. The conduit 146 delivers the cut ribs 113 to the guide 48 of FIG. 1 in the same way as described for the conduit 46 and guide 48 of FIG. 1. The reference character 188 denotes in FIG. 7 a motor which drives the rotor member 153 through the belt 152.

An advantage of the clearance 184 and of the feature that it receives compressed gaseous carrier medium from the plenum chamber 186 is that the cut and/or uncut ribs 113 cannot accumulate between stationary and rotary parts of the cutter 144 but are compelled to enter the chamber 159 and to thereupon advance through the channel 162 and into the conduit 146 for transport toward the path for the flow 22.

The improved method and apparatus can be modified in a number of additional ways without departing from the spirit of the invention. For example, such method and apparatus can be practiced in connection with the making of a single rod-like tobacco filler (as actually shown in FIGS. 1 to 9) as well as in connection with simultaneous making of two or more rod-like fillers. Reference may be had, for example, to commonly owned U.S. Pat. No. 4,889,138 (granted Dec. 26, 1989 to Heitmann et al. for "Method of and apparatus for simultaneously making plural tobacco stream"), U.S. Pat. No. 4,893,640 (granted Jan. 16, 1990 to Heitmann et al. for "Multiple-rod cigarette making machine") and U.S. Pat. No. 4,924,884 (granted May 15, 1990 to Heitmann et al. for "Method of and apparatus for building, guiding and trimming streams of fibrous material"). All that is necessary is to properly distribute the cut ribs in two or more flows of tobacco shreds so that the cut ribs enter the desired portions of the respective fillers. For example, if the machine is designed to make two cigarette rods, the segregated, separated and comminuted (preferably cut) ribs can be divided into two equal or nearly equal streams and each such stream is admitted into one of the two flows of shreds.

It is further within the purview of the invention to withdraw tobacco duct at one, two or more locations in the distributor of or elsewhere in a rod making machine and to introduce the thus collected tobacco dust into the flow or flows of tobacco shreds jointly with the cut ribs so that the particles of tobacco dust will be confined in the central portion(s) 72*b* of the (respective) filler(s) 72. Such introduction of dust contributes to more economical utilization of tobacco and ensures that the particles of dust are properly confined in that portion of the filler where they are least likely to escape in a cigarette packet or during smoking.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making at least one stream of first and second tobacco particles, comprising the steps of accumulating the first and second particles and randomly distributed foreign particles into an elongated flow of particles and advancing the flow along a predetermined path; segregating the second and foreign particles from the flow in at least one predetermined portion of said path; thereupon separating the second particles from foreign particles; thereupon comminuting at least some of the separated second particles; converting successive increments of the advancing flow, in a second portion of said path downstream of said at least one first portion, into an elongated stream having an outer portion and an inner portion surrounded by said outer portion; and effecting the introduction of at least some comminuted second particles into the inner portion of the elongated stream, including admitting said at least some comminuted second particles into said path between said first and second portions.

2. The method of claim 1, further comprising the step of transporting the elongated stream away from said second portion along a second path transversely of said predetermined path.

3. The method of claim 1, wherein the foreign particles are heavier than the second particles, said separating step including separating the second particles from foreign particles by sieving.

4. The method of claim 1, wherein the segregated second particles include particles of different sizes and/or shapes, said comminuting step including jointly comminuting separated second particles of different sizes and/or shapes.

5. The method of claim 1, wherein the inner portion of the stream includes a center of the elongated stream and said introduction effecting step includes effecting the introduction of said at least some comminuted second particles at least close to the center of the elongated stream.

6. The method of claim 1, wherein said comminuting step includes cutting said at least some separated second particles.

7. The method of claim 1, wherein the second and foreign particles are heavier than first particles and said segregating step includes pneumatically separating at least a majority of first particles from the second and foreign particles.

8. The method of claim 1, wherein the first particles include or constitute tobacco shreds, the second particles include or constitute fragments of tobacco ribs, and the foreign particles include metallic and/or plastic objects.

9. The method of claim 1, wherein said converting step includes transforming the flow into an elongated stream which contains a surplus of first particles, and further comprising the step of removing the surplus from the elongated stream.

10. Apparatus for making at least one stream of first and second tobacco particles, comprising means for accumulating first and second particles and randomly distributed foreign particles into an elongated flow of particles, including means for advancing the flow in a predetermined direction along a predetermined path; means for segregating second and foreign particles from the flow in at least one first portion of said path; means for separating segregated second particles from segregated foreign particles; means for comminuting at least some separated second particles; means for converting successive increments of the advancing flow, in a second portion of said path downstream of said at least one first portion, into an elongated stream having an outer portion and an inner portion surrounded by the outer portion; and means for effecting the introduction of at least some comminuted second particles into the inner portion of the elongated stream, including means for admitting the at least some comminuted second particles into said path between said first and second portions.

11. The apparatus of claim 10, wherein said converting means comprises means for transporting the elongated stream along a second path in a second direction transversely of said predetermined path.

12. The apparatus of claim 11, wherein said second portion of said predetermined path is adjacent said transporting means and includes an upstream end and a downstream end, as seen in said second direction, said admitting means including means for returning at least some comminuted second particles into said predetermined path at a location such that the returned comminuted second particles reach said second portion intermediate said upstream and downstream ends.

13. The apparatus of claim 11, wherein said separating means includes a pneumatic sifting device.

14. The apparatus of claim 11, wherein said comminuting means comprises a rotary cutting device.

15. The apparatus of claim 14, wherein said cutting device comprises a stator member and a rotor member surrounding said stator member, said members defining a first chamber for reception of second particles to be comminuted and a further chamber which discharges comminuted second particles.

16. The apparatus of claim 15, wherein said cutting device further comprises means for pneumatically evacuating comminuted second particles from said further chamber.

17. The apparatus of claim 16, wherein said further chamber has an inlet and an outlet, said evacuating means comprising a conduit extending through said stator member and connecting the inlet of said further chamber with the atmosphere and an ejector which draws comminuted second particles from the further chamber through said outlet.

18. The apparatus of claim 15, wherein said stator member comprises a plurality of cutting arms for second particles.

19. The apparatus of claim 18, wherein the number of said cutting arms exceeds two.

20. The apparatus of claim 15, wherein each of said members comprises a plurality of cutting elements which are spaced apart from each other in the axial direction of said rotor member, each cutting element of said stator member cooperating with a cutting element of said rotor member to sever second particles intermediate of and/or in said chambers.

21. The apparatus of claim 14, wherein said separating means has an outlet for second particles and said cutting device has an inlet for separated second particles, and further comprising a conduit connecting said outlet with said inlet and an ejector provided in said conduit to promote the transfer of separated second particles into said cutting device.

22. The apparatus of claim 10, further comprising means for pneumatically conveying separated second particles from said separating means to said comminuting means, including a centrifugal separator having an inlet connected with said separating means for reception of separated second particles in a gaseous carrier medium, a first outlet for admission of separated second particles into said comminuting means, and a second outlet for gaseous carrier medium.

23. The apparatus of claim 22, further comprising a gate disposed between said first outlet and said comminuting means to permit passage of second particles but to intercept the carrier medium.

24. The apparatus of claim 23, wherein said comminuting means comprises a first chamber which receives second particles from said gate and a further chamber for evacuation of comminuted second particles from said comminuting means.

25. The apparatus of claim 10, wherein said comminuting means comprises a housing, a rotor member disposed in said housing, and a stator member surrounded by and defining with said rotor member an annular clearance for evacuation of a gaseous carrier medium for second particles from said comminuting means.

26. The apparatus of claim 25, wherein said members define a first chamber which receives from said separating means separated second particles in said gaseous carrier medium, and a further chamber for reception of comminuted second particles, said comminuting means further comprising means for pneumatically evacuating comminuted second particles from said further chamber, said clearance defining a path for withdrawal of carrier medium and including an enlarged portion at said further chamber.

* * * * *